US011136981B2

(12) United States Patent
Ahn et al.

(10) Patent No.: US 11,136,981 B2
(45) Date of Patent: Oct. 5, 2021

(54) SCROLL COMPRESSOR HAVING SHAFT FRAME SUPPORT INCLUDING GUIDE HOLES TO FLOW OIL FOR BEARING LUBRICATION

(71) Applicant: LG ELECTRONICS INC., Seoul (KR)

(72) Inventors: Sungyong Ahn, Seoul (KR); Jinho Kim, Seoul (KR); Junghoon Park, Seoul (KR); Junchul Oh, Seoul (KR); Byeongchul Lee, Seoul (KR); Jaeha Lee, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 184 days.

(21) Appl. No.: 16/330,855

(22) PCT Filed: Sep. 6, 2017

(86) PCT No.: PCT/KR2017/009760
§ 371 (c)(1),
(2) Date: Apr. 10, 2019

(87) PCT Pub. No.: WO2018/048190
PCT Pub. Date: Mar. 15, 2018

(65) Prior Publication Data

US 2019/0390675 A1 Dec. 26, 2019

(30) Foreign Application Priority Data

Sep. 6, 2016 (KR) ..... 10-2016-0114311

(51) Int. Cl.
*F04C 29/02* (2006.01)
*F04C 18/02* (2006.01)

(52) U.S. Cl.
CPC ..... *F04C 29/028* (2013.01); *F04C 18/0207* (2013.01); *F04C 18/0215* (2013.01); *F04C 29/02* (2013.01)

(58) Field of Classification Search
CPC .... F04C 29/028; F04C 18/0207; F04C 18/02; F04C 29/02; F04C 18/0215
See application file for complete search history.

(56) References Cited

U.S. PATENT DOCUMENTS 4,623,306 A 11/1986 Nakamura et al.
4,772,188 A * 9/1988 Kimura ..... F04C 18/04 418/55.1

(Continued)

FOREIGN PATENT DOCUMENTS

JP 64-29685 1/1989
JP 3731068 1/2006

(Continued)

OTHER PUBLICATIONS

International Search Report (with English Translation) and Written Opinion dated Jan. 29, 2018 issued in Application No. PCT/KR2017/009760.

*Primary Examiner* — Mary Davis
*Assistant Examiner* — Paul W Thiede
(74) *Attorney, Agent, or Firm* — Ked & Associates LLP

(57) ABSTRACT

A scroll compressor may include a rotational shaft, the rotational shaft including a first frame support having an inner circumferential surface, into which a boss of a first scroll is inserted, and an outer circumferential surface that forms an outer surface of the rotational shaft; and at least one guide hole that extends from the inner circumferential surface to the outer circumferential surface.

17 Claims, 10 Drawing Sheets

(56) References Cited

U.S. PATENT DOCUMENTS

| | | | | |
|---|---|---|---|---|
| 4,792,296 | A * | 12/1988 | Kobayashi | F04C 29/023 418/55.6 |
| 2010/0254835 | A1* | 10/2010 | Kane | F04C 18/0215 417/410.1 |
| 2013/0078131 | A1* | 3/2013 | Ahn | F04C 18/0253 418/55.4 |
| 2018/0231002 | A1* | 8/2018 | Lee | F04C 18/0215 |

FOREIGN PATENT DOCUMENTS

| | | |
|---|---|---|
| KR | 1986-0001682 | 7/1986 |
| KR | 10-0882481 | 2/2009 |
| KR | 10-2013-0034536 | 4/2013 |

* cited by examiner

SCROLL COMPRESSOR HAVING SHAFT FRAME SUPPORT INCLUDING GUIDE HOLES TO FLOW OIL FOR BEARING LUBRICATION

This application is a U.S. National Stage Application under 35 U.S.C. § 371 of PCT Application No. PCT/KR2017/009760, filed Sep. 6, 2017, which claims priority to Korean Patent Application No. 10-2016-0114311, filed Sep. 6, 2016, whose entire disclosures are hereby incorporated by reference.

FIELD

A scroll compressor is disclosed herein.

BACKGROUND

A scroll compressor is a compressor using a fixed scroll having a fixed wrap and an orbiting scroll performing an orbiting movement with respect to the fixed scroll and having an orbiting wrap. In the scroll compressor, a volume of a compression chamber formed between the fixed scroll and the orbiting scroll is reduced along with the orbiting movement of the orbiting scroll while the fixed scroll and the orbiting scroll are rotated together, and a pressure of a fluid is increased to discharge the fluid from a discharge port provided at a center of the fixed scroll.

In such a scroll compressor, suction, compression, and discharge are continuously performed while the orbiting scroll is rotating. Therefore, in principle, a discharge valve and a suction valve are not required. As the number of parts is small, the structure is simple, and high speed rotation can be achieved. In addition, as the change of the torque required for compression is small and suction and compression are continuously performed, noise and vibration are small.

The applicant of the present application has filed an application, which is hereby incorporated by reference, as follows in relation to a scroll compressor.

1. Title of invention: Oil Supply Structure of Scroll Compressor

2. Registration Number (Registered Date): 10-0882481 (Feb. 2, 2009)

According to the conventional art, a boss part is provided at a bottom of an end plate of an orbiting scroll, an upper portion of a rotational shaft is inserted into an inner circumferential surface of the boss part, and a bearing is coupled to an upper portion of the rotational shaft. According to this configuration, as a supporting point at which the rotational shaft is supported by the main frame is positioned higher than an action point at which the rotational shaft acts on the orbiting scroll, the rotational shaft is subjected to a large eccentric load. Therefore, compression efficiency due to friction loss of the bearing is lowered and compressor noise is increased.

According to the conventional art, oil of an oil passage formed inside the rotational shaft is pumped upward by a rotational force of the rotational shaft (centrifugal force) and is supplied to the wrap of the orbiting scroll and the wrap of the fixed scroll (centrifugal oil supply system). According to the centrifugal oil supply system, when an operation speed of the compressor is high, an amount of supplied oil may be large, but when the operation speed of the compressor is low, the amount of supplied oil may be small and friction between the orbiting scroll and the fixed scroll increases, and an oil sealing effect inside the compression part is reduced, thus deteriorating reliability and performance of the compressor.

SUMMARY

The present invention has been made an effort to solve the above problems, and an object of the present invention is to provide a scroll compressor capable of reducing a friction loss of a bearing by reducing an eccentric load applied to a rotational shaft, thereby improving compression efficiency. The present invention also relates to a scroll compressor capable of easily supplying oil toward a wrap of a fixed scroll and a wrap of an orbiting scroll.

The present invention also relates to a scroll compressor capable of preventing oil supply performance from being deteriorated by the presence of gaseous refrigerant in a space between a first bearing and a rotational shaft at initial start of the compressor. The present invention also relates to a scroll compressor in which oil is prevented from being discharged upward through an open space between an upper end portion of a rotational shaft and a first bearing, and oil supply to a second bearing side can be facilitated.

A scroll compressor according to an embodiment includes a rotational shaft. The rotational shaft includes a first frame support part having an inner circumferential surface portion or surface, into which a boss part or boss of a first scroll is inserted, and an outer circumferential surface portion or surface forming an outer surface; and a guide hole that penetrates from the inner circumferential surface portion toward the outer circumferential surface portion. A first recess part or recess formed in the inner circumferential surface portion is further included.

A second recess part or recess formed in the outer circumferential surface portion is further included. The guide hole extends from the first recess part toward the second recess part.

A jaw forming an upper end of the second recess part is further included. The jaw includes a stepped part or step that extends from the upper end of the second recess part in a radial direction and connected to the outer circumferential surface portion.

A first supply passage formed between the first recess part and the second bearing is further included. A second supply passage formed between the second recess part and the first bearing is further included.

The first supply passage and the second supply passage may communicate with each other by or via the guide hole. The first supply passage may transfer oil discharged from the oil passage to the second supply passage.

The first scroll includes a first end plate part or plate and a first wrap that extends upward from the first end plate part. The boss part extends downward from the first end plate part.

The second bearing is provided on the outer circumferential surface of the boss part. The first bearing is provided on the outer circumferential surface portion of the rotational shaft.

The guide hole includes a first guide hole that communicates with the lower portion of the second recess part. The guide hole includes a second guide hole that communicates with the upper portion of the second recess part.

The end plate part of the first scroll includes a pin insertion part or portion in which a decompression pin is installed. A communication hole that is formed on a bottom surface of the end plate part and guides oil to the pin insertion part is further included.

A scroll compressor according to another embodiment includes a first bearing provided between a main frame and an outer circumferential surface portion or surface of a rotational shaft; a second bearing provided between a boss part or boss of a first scroll and an inner circumferential surface portion or surface of the rotational shaft; a first supply passage formed between the second bearing and the inner circumferential surface portion of the rotational shaft; and a second supply passage formed between the first bearing and the outer circumferential surface portion of the rotational shaft. In addition, a guide hole that connects the first supply passage to the second supply passage is further included.

A scroll compressor according to another embodiment includes a rotational shaft having an outer circumferential surface portion or surface and an inner circumferential surface portion or surface; a main frame that supports a frame support part or support of the rotational shaft; a first scroll supported by the main frame and performing an orbiting movement by the rotation of the rotational shaft; a first bearing provided between the main frame and the outer circumferential surface portion of the rotational shaft; and a second bearing provided between a boss part or boss of the first scroll and the inner circumferential surface portion of the rotational shaft.

The scroll compressor further includes a first supply passage formed between the second bearing and the inner circumferential surface portion of the rotational shaft; a second supply passage formed between the first bearing and the outer circumferential surface portion of the rotational shaft; and a guide hole formed in the rotational shaft and connecting the first supply passage to the second supply passage. The main frame includes a frame outer wall having an annular shape; and a frame inner wall disposed inside the frame outer wall and having a shaft insertion part or portion into which the rotational shaft is inserted.

The first bearing is installed in the shaft insertion part, and the frame support part is connected to the inside of the first bearing. The frame support part includes a bearing insertion part or portion into which the boss part and the second bearing are inserted, and the inner circumferential surface portion of the rotational shaft extends downward from the bearing insertion part and forms an inner circumferential surface portion or surface of the frame support part.

The frame support part includes a bearing insertion part or portion into which the boss part and the second bearing are inserted, and the inner circumferential surface portion of the rotational shaft extends downward from the bearing insertion part and forms an inner circumferential surface portion or surface of the frame support part. The inner circumferential surface portion and the outer circumferential surface portion extend in a circumferential direction.

The guide hole extends from a first recess part or recess of the inner circumferential surface portion toward a second recess part or recess of the outer circumferential surface portion. A jaw that extends from the second recess part in an outwardly radial direction and connected to the outer circumferential surface portion is further included.

According to the embodiments, as a boss part or boss of an orbiting scroll is configured to be inserted into an upper portion of a rotational shaft and a main frame is supported on an outer side of the rotational shaft, frictional loss of a bearing can be reduced by reducing an eccentric load acting on the rotational shaft, and thus, compression efficiency can be improved. In addition, oil that has flowed upward through an oil passage in the rotational shaft is branched and supplied to a first branch passage that flows to a decompression pin and a second branch passes that flows to first and second bearings, and is then fed to a wrap of a fixed scroll and a wrap of an orbiting scroll, thereby improving oil supply performance.

A guide hole that guides flow of oil to a first frame support part or support provided at the upper portion of the rotational shaft is formed, such that the oil raised through the oil passage can be easily supplied toward the second bearing through the first bearing. As a plurality of guide holes are provided in a vertical direction, refrigerant remaining between the first bearing and the rotational shaft can be discharged to the outside of the first bearing at an initial start of the compressor, thereby improving oil supply performance and compression efficiency.

In addition, as a jaw that can cover the space between the first bearing and the rotational shaft is present at the upper portion of the rotational shaft, the oil can be prevented from flowing upward through a space between the upper end of the rotational shaft and the first bearing, and the oil can also be appropriately supplied to the second bearing.

DETAILED DESCRIPTION

Figure 1:
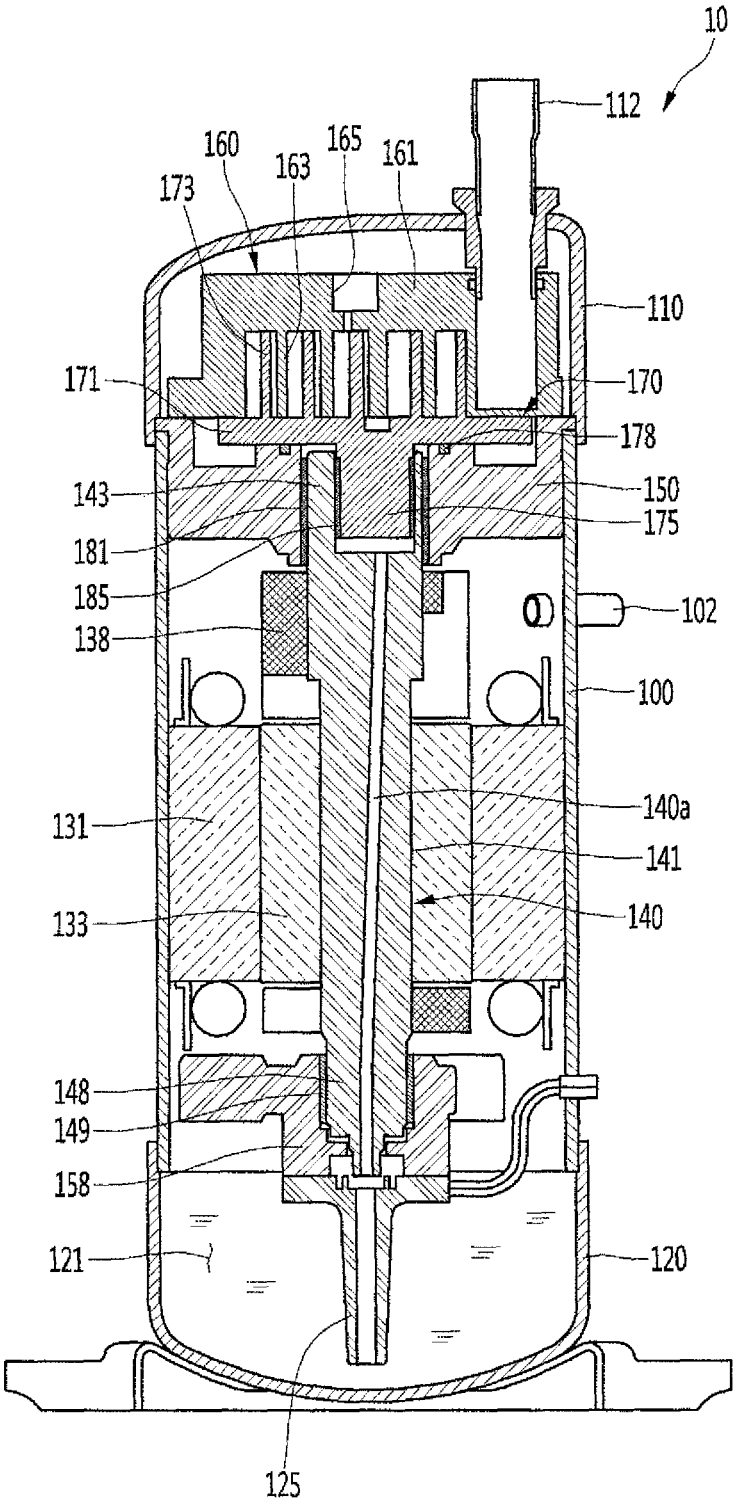
FIG. 1 is a cross-sectional view illustrating a structure of a scroll compressor according to an embodiment.

FIG. 1 is a cross-sectional view illustrating a structure of a scroll compressor according to an embodiment. Referring to FIG. 1, a scroll compressor 10 according to an embodiment of includes a casing 100 which forms an internal space and is coupled to a discharge part or outlet 102. For example, the discharge part 102 may be coupled to an outer circumferential surface of the casing 100.

The scroll compressor 10 includes a top cover 110 provided above the casing 100 and coupled to a suction part or outlet 112 through which refrigerant is suctioned, and a bottom cover 120 provided below the casing 100 and forming an oil chamber 121 for storing oil. For example, the suction part 112 may be coupled to a top surface of the top cover 110.

The casing 100, the top cover 110, and the bottom cover 120 may be collectively referred to as an "airtight container". In an inside of the airtight container, a refrigerant compressed at a high pressure exists. Therefore, an internal pressure of the airtight container can form a discharge pressure (high pressure) of the scroll compressor 10.

A motor is installed inside the casing 100. The motor includes a stator 131 coupled to an inner wall surface of the casing 100 and a rotor 133 rotatably provided in the stator 131. The scroll compressor 10 further includes a rotational shaft 140 arranged to pass through an inside of the rotor 133. The rotational shaft 140 includes a shaft part or shaft 141 extending in a vertical direction (or an axial direction), a first frame support part or support 143 that extends upward from the shaft part 141, and a second frame support part or support 148 that extends downward from the shaft part 141.

Directions will be defined hereinafter. With reference to FIG. 1, a vertical direction, that is, a direction in which the rotational shaft 140 extends is defined as an "axial direction", and a direction perpendicular to the axial direction is defined as a "radial direction". The definition of these directions can be equally applied throughout the specification.

The first frame support part 143 is rotatably supported by a first bearing 181. The first bearing 181 may surround an outer side of the first frame support part 143 and may be positioned on an inner circumferential surface of a main frame 150. That is, the first bearing 181 may be disposed between an outer circumferential surface of the first frame support part 143 and the inner circumferential surface of the main frame 150.

The second frame support part 148 is rotatably supported by a lower bearing 149. The lower bearing 149 may surround an outer side of the second frame support part 148 and may be positioned on an inner circumferential surface of a lower frame 158. That is, the lower bearing 149 may be disposed between an outer circumferential surface of the second frame support part 148 and the inner circumferential surface of the lower frame 158.

An oil supply part or supply 125 that supplies oil stored in an oil chamber 121 to the rotational shaft 140 is provided below the lower frame 158. The oil supply part 125 may be coupled to a bottom surface of the lower frame 158. The oil stored in the oil chamber 121 may be supplied upward through the oil supply part 125 to flow through an oil passage 140*a* of the rotational shaft 140.

The oil passage 140*a* penetrates an inside of the rotational shaft 140 and extends upward to guide the oil supplied from the oil supply part 125 to an upper side of the rotational shaft 140. The rotational shaft 140 is eccentrically coupled to an orbiting scroll 170, and the oil passage 140*a* can extend to be inclined upward.

The main frame 150 is fixed to an inner wall surface of the casing 100 and includes an inner circumferential surface on which the first bearing 181 is installed. The first bearing 181 supports the rotational shaft 140 such that the rotational shaft 140 can rotate smoothly.

An orbiting scroll 170 is disposed on or at an upper surface of the main frame 150. The orbiting scroll 170 includes a first end plate part or plate 171 having a substantially disk shape and placed on the main frame 150, and an orbiting wrap 173 that extends from the first end plate part 171 and formed in a spiral shape.

The first end plate part 171 forms a central portion of the orbiting scroll 170 as a main body of the orbiting scroll 170, and the orbiting wrap 173 extends upward from the first end plate part 171 to form an upper side of the orbiting scroll 170. The orbiting wrap 173 forms a compression chamber together with a fixed wrap 163 of a fixed scroll 160 described hereinafter. The orbiting scroll 170 may be referred to as a "first scroll", and the fixed scroll 160 may be referred to as a "second scroll".

The first end plate part 171 of the orbiting scroll 170 performs an orbiting movement in a state of being supported on the upper surface of the main frame 150. An oldham ring 178 is provided between the first end plate part 171 and the upper surface of the main frame 150 to prevent the orbiting scroll 170 from orbiting.

The orbiting scroll 170 further includes a boss part or boss 175 that extends downward from the first end plate part 171. The boss part 175 is configured to be inserted into the first frame support part 143 of the rotational shaft 140 to easily transmit the rotational force of the rotational shaft 140 to the orbiting scroll 170. The central portion of the rotational shaft 140, that is, the central portion of the first frame support part 143, and the central portion of the boss part 175 are eccentric. Therefore, the orbiting scroll 170 can perform the orbiting movement by rotation of the rotational shaft 140.

An eccentric mass 138 that cancels an eccentric load generated when the orbiting scroll 170 performs the orbiting movement may be coupled to an upper portion of the shaft part 141. For example, the eccentric mass 138 may be coupled to an outer circumferential surface of the shaft part 141.

A second bearing 185 that supports the movement of the orbiting scroll 170 is provided on an outer circumferential surface of the boss part 175. The second bearing 185 may be disposed between an inner circumferential surface of the first frame support part 143 and the outer circumferential surface of the boss part 175.

The fixed scroll 160 engaged with the orbiting scroll 170 is disposed above the orbiting scroll 170. The fixed scroll 160 includes a second end plate part or plate 161 having a substantially disk shape, and the fixed wrap 163 which extends from the second end plate part 161 toward the first end plate part 171 and is engaged with the orbiting wrap 173.

The second end plate part 161 forms an upper portion of the fixed scroll 160 as a main body of the fixed scroll 160, and the fixed wrap 163 extends downward from the second end plate part 161 to form a lower portion of the fixed scroll 160. For convenience of explanation, the orbiting wrap 173 may be referred to as a "first wrap", and the fixed wrap 163 may be referred to as a "second wrap".

A lower end of the fixed wrap 163 may be disposed in contact with the first end plate part 171, and an end of the orbiting wrap 173 may be disposed in contact with the second end plate part 161. A length of the orbiting wrap 173 extending from the first end plate part 171 to the second end plate part 161 may be formed to be equal to a length of the fixed wrap 163 extending from the second end plate part 161 to the first end plate part 171. Hereinafter, the length can be referred to as a "height" of the wrap.

The fixed wrap 163 extends in a spiral shape, and a discharge port 165 through which the compressed refrigerant is discharged is formed in a substantially central portion of the second end plate part 161. The suction part 112 is coupled to the fixed scroll 160, and the refrigerant suctioned through the suction part 112 flows into a compression chamber formed by the orbiting wrap 173 and the fixed wrap 163.

At least a part of the oil supplied through the oil passage 140*a* may be supplied to the compression chamber through the orbiting scroll 170 and the fixed scroll 160. The remaining oil is supplied to the inner circumferential surface and the outer circumferential surface of the first frame support part 143, that is, the second bearing 185 and the first bearing 181, to perform a lubrication and cooling function, and may be supplied to the compression chamber. Hereinafter, structure and operation of the oil supply passage will be described with reference to the drawings.

Figure 2:
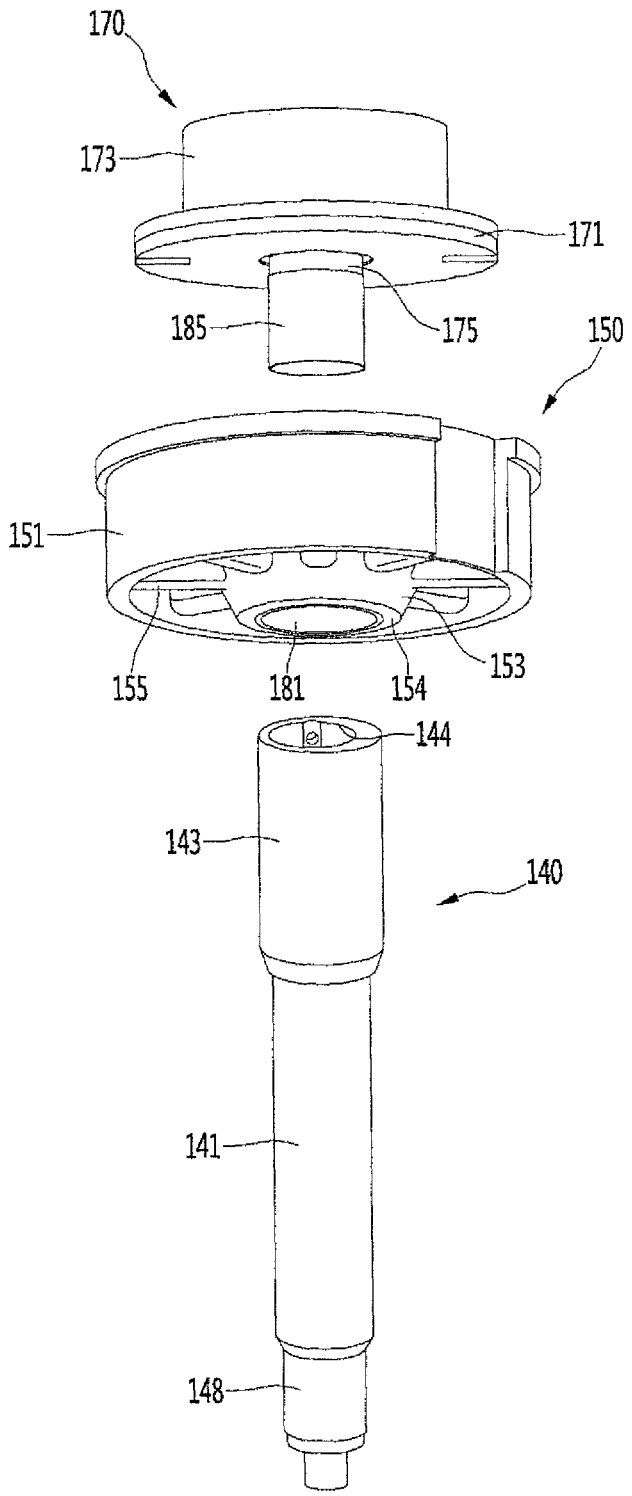
FIG. 2 is a partially exploded cross-sectional view illustrating a structure of a scroll compressor according to an embodiment.
Figure 3:
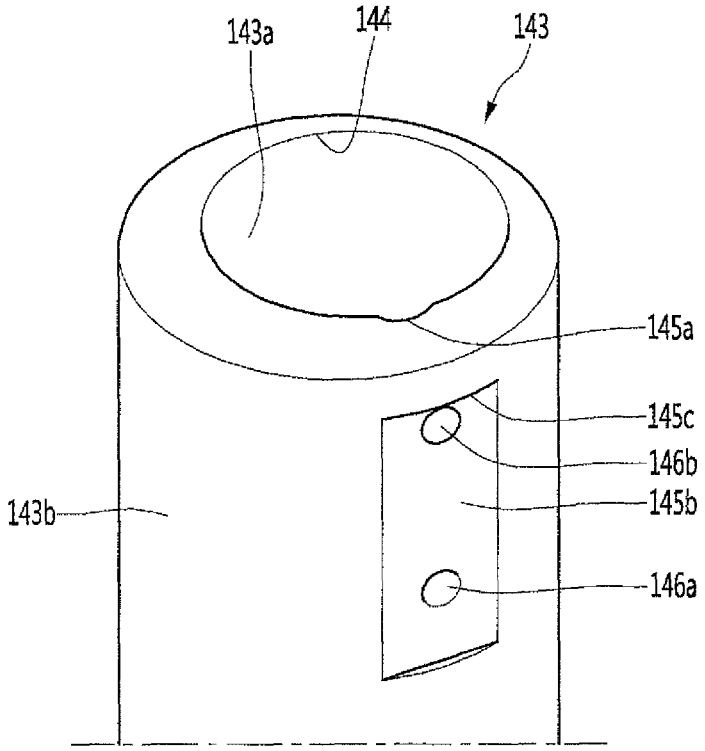
FIGS. 3 and 4 are perspective views illustrating an upper structure of a rotational shaft according to an embodiment.
Figure 4:
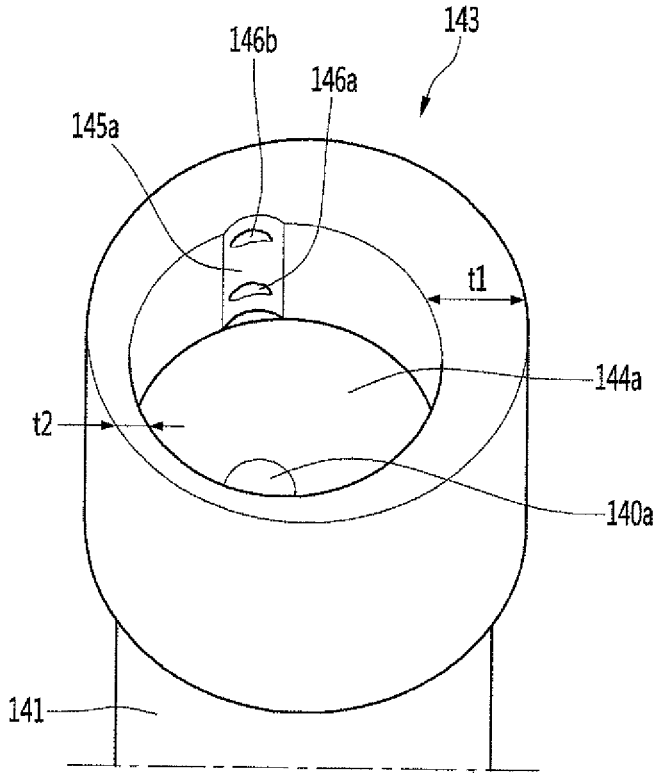

FIG. 2 is a partially exploded cross-sectional view illustrating a structure of a scroll compressor according to an embodiment. FIGS. 3 and 4 are perspective views illustrating an upper structure of a rotational shaft according to an embodiment.

Referring to FIGS. 2 to 4, the scroll compressor 10 according to the embodiment includes the rotational shaft 140, the main frame 150, and the orbiting scroll 170. The main frame 150 includes a frame outer wall 151 having a substantially annular shape, and a frame inner wall 153 which is disposed inside the frame outer wall 151 and has a shaft insertion part 154 into which the first frame support part 143 of the rotational shaft 140 is inserted. The shaft insertion part 154 is provided with the first bearing 181, and the first frame support part 143 is coupled to the inside of the first bearing 181. The main frame 150 includes a frame extension part or portion 155 extending in the radial direction from the frame inner wall 153 toward the frame outer wall 151.

The rotational shaft 140 includes the shaft part 141, the first frame support part 143 that extends upward from the shaft part 141 and supported by the main frame 150, and the second frame support part 148 that extends downward from the shaft part 141 and supported by the lower frame 158. For example, an outer diameter of the first frame support part 143 may be larger than an outer diameter of the shaft part 141. Therefore, the first frame support part 143 can easily accommodate the boss part 175 of the orbiting scroll 170. The outer diameter of the shaft part 141 may be larger than an outer diameter of the second frame support part 148.

The first frame support part 143 and the first bearing 181 may be inserted into the shaft insertion part 154, and the boss part 175 and the second bearing 185 may be inserted into the first frame support part 143. The first frame support part 143 includes a bearing insertion part or portion 144 into which the boss part 175 and the second bearing 185 are inserted. The bearing insertion part 144 may be formed by opening an upper end of the first frame support part 143.

The first frame support part 143 further includes an inner circumferential surface portion 143*a* that extends downward from the bearing insertion part 144 and forming the inner circumferential surface of the first frame support part 143. The inner circumferential surface portion 143*a* may extend in the circumferential direction. The first frame support part 143 further includes an outer circumferential surface portion 143*b* forming an outer surface. As the first frame support part 143 has a substantially cylindrical shape, the outer circumferential surface portion 143*b* may extend in the circumferential direction.

The first frame support part 143 includes a bottom surface portion or surface 144*a* forming a lower end portion of the inner circumferential surface portion 143*a*. The bottom surface portion 144*a* forms a bottom surface of an insertion space where the boss part 175 is positioned and can be connected to the oil passage 140*a*.

The first frame support part 143 includes a first recess part 145*a* which is recessed from the inner circumferential surface portion 143*a*. The first recess part 145*a* may have a shape that is recessed radially outward from the inner circumferential surface portion 143*a*. For example, the first recess part 145*a* may have a rounded recessed shape. Due to the structure of the first recess part 145*a*, an oil supply passage 147*a* through which the oil flows can be formed in a space between the first recess part 145*a* and the second bearing 185. The oil supply passage may be referred to as a "first supply passage 147*a* (see FIG. 6)".

The first frame support part 143 includes a second recess part 145*b* which is recessed from the outer circumferential surface portion 143*b*. The second recess part 145*b* may have a shape that is recessed radially inward from the outer circumferential surface portion 143*b*. The second recess part 145*b* may be formed to extend in the vertical direction. Due to the structure of the second recess part 145*b*, an oil supply passage 147*b* through which the oil flows can be formed in a space between the second recess part 145*b* and the first bearing 181. The oil supply passage may be referred to as a "second supply passage 147*b* (see FIG. 6)". The first supply passage 147*a* can transfer the oil discharged from the oil passage 140*a* to the second supply passage 147*b*.

The outer circumferential surface portion 143*b* includes a jaw 145*c* forming an upper end of the second recess part 145*b*. The jaw 145*c* can be understood as a "stepped part" or "step" that extends radially outward from an upper end of the second recess part 145*b* and connected to the outer circumferential surface portion 143*b*.

The jaw 145*c* may restrict the oil flowing through the second supply passage 147*b* from flowing upward through an upper end of the first frame support part 143. Therefore, the oil supplied through the oil passage 140*a* of the rotational shaft 140 is prevented from concentrating or in on the second supply passage 147*b*, and the oil can be appropriately supplied to the first supply passage 147*a*.

The first frame support part 143 includes guide holes 146*a* and 146*b* that provide communication between the first supply passage 147*a* and the second supply passage 147*b*. The guide holes 146*a* and 146*b* may extend from the first recess part 145*a* toward the second recess part 145*b*. In other words, the guide holes 146*a* and 146*b* are formed to penetrate from the first recess part 145*a* to the second recess part 145*b*.

The guide holes 146*a* and 146*b* are provided in plurality. The plurality of guide holes 146*a* and 146*b* may be spaced apart in the vertical direction. The plurality of guide holes 146*a* and 146*b* include a first guide hole 146*a*, and a second guide hole 146*b* above the first guide hole 146*a*.

The oil may flow from the first supply passage 147*a* to the second supply passage 147*b* through the guide holes 146*a* and 146*b*, or may flow from the second supply passage 147*b* to the first supply passage 147*a* through the guide holes 146*a* and 146*b*. In particular, when the scroll compressor 10 is initially started, gaseous refrigerant remaining in the second supply passage 147*b* may be discharged from the second supply passage 147*b* together with the flowing oil. As a result, a phenomenon that the flow of the oil is disturbed by the gaseous refrigerant, that is, vapor lock, can be prevented.

On the other hand, a thickness of the first frame support part 143, that is, a distance from the inner circumferential surface portion 143*a* to the outer circumferential surface portion 143*b*, may be different with respect to the circumferential direction. For example, as illustrated in FIG. 4, a thickness t1 at one point of the first frame support part 143 may be larger than a thickness t2 at another point. With such a configuration, the boss part 175 of the orbiting scroll 170 can be eccentrically coupled to the first frame support part 143.

Figure 5:
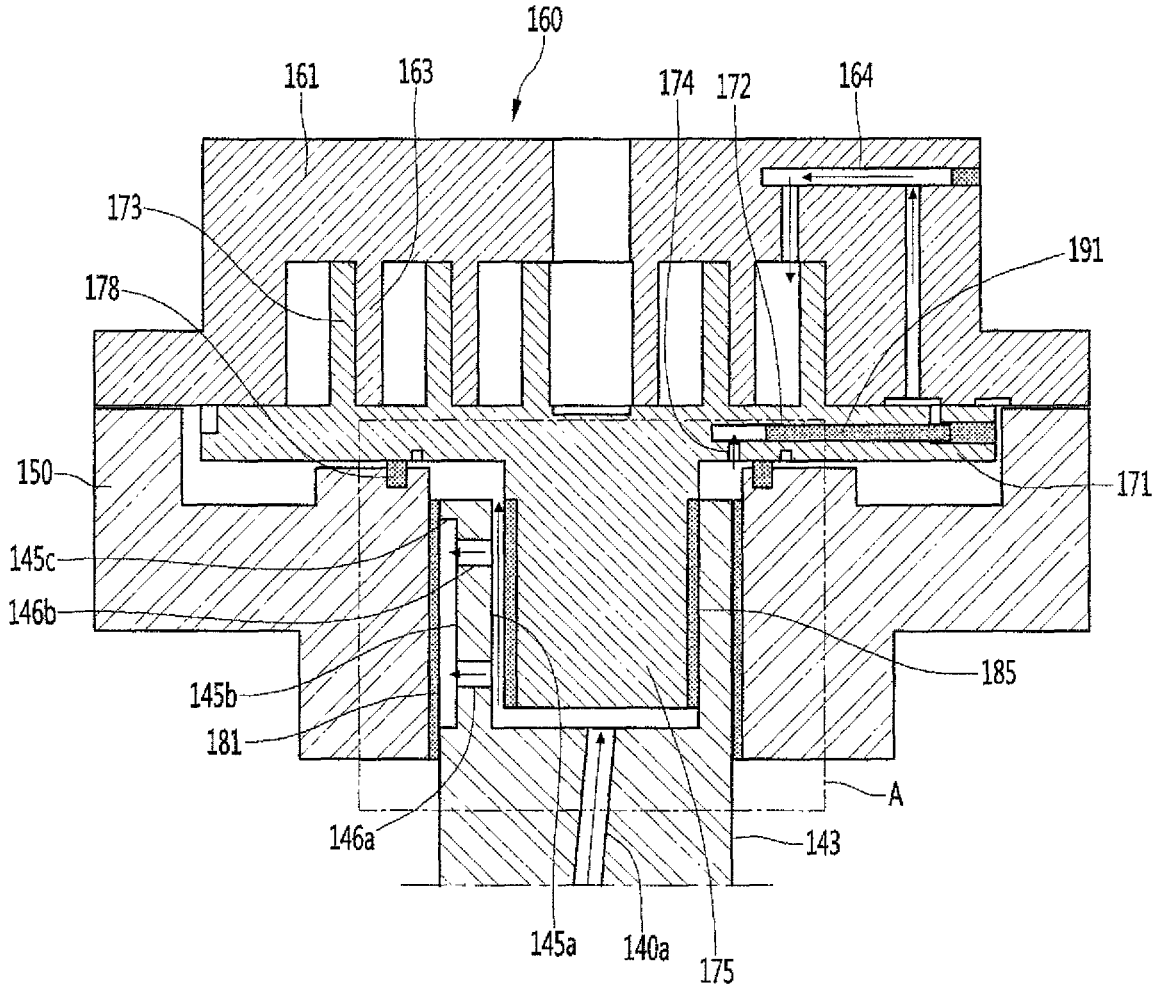
FIG. 5 is a cross-sectional view illustrating a coupling structure of a rotational shaft, an orbiting scroll, and a main frame according to an embodiment of the present invention.
Figure 6:
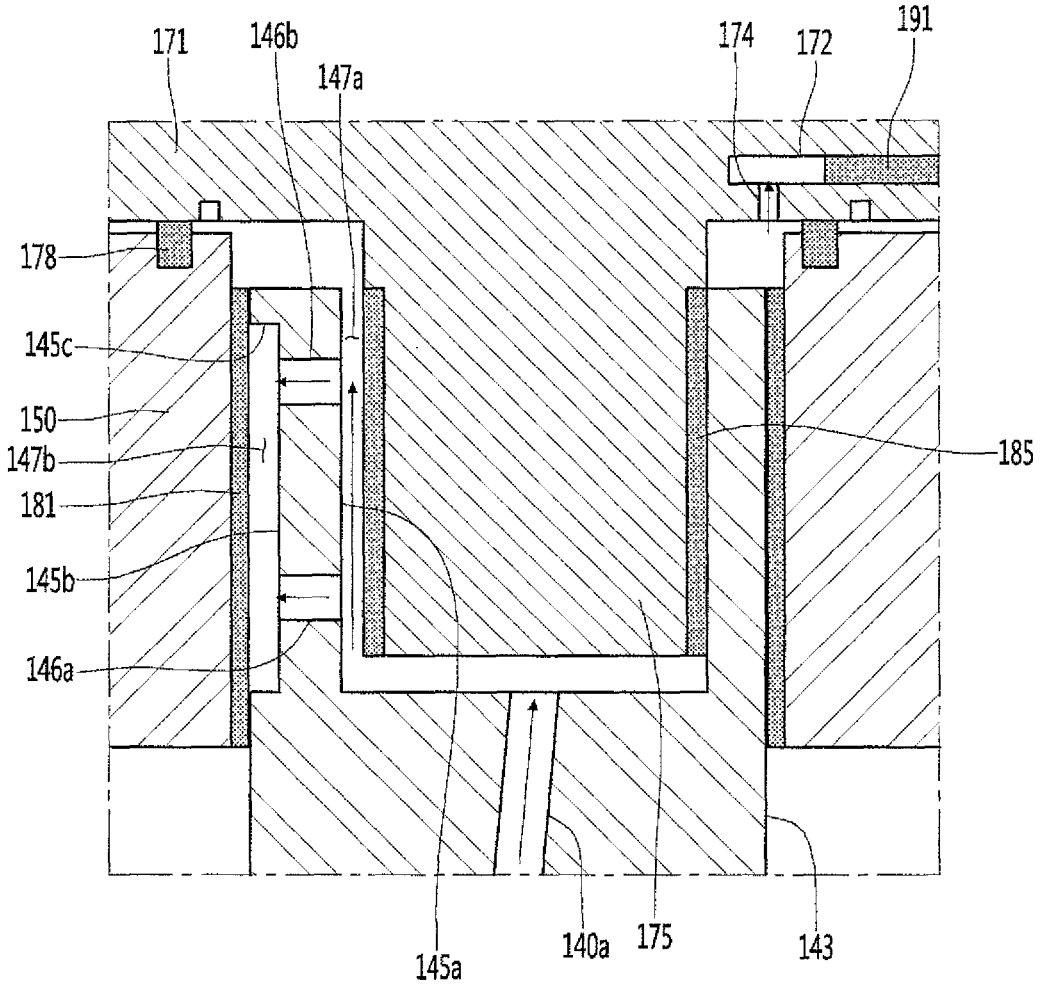
FIG. 6 is an enlarged view illustrating a portion "A" of FIG. 5.

FIG. 5 is a cross-sectional view illustrating a coupling structure of the rotational shaft, the orbiting scroll, and the main frame according to an embodiment. FIG. 6 is an enlarged view illustrating a portion "A" of FIG. 5.

Referring to FIGS. 5 and 6, the scroll compressor 10 according to the embodiment includes a decompression pin 191 that lowers a pressure of oil. The first end plate part 171 of the orbiting scroll 170 is formed with a pin insertion part or portion 172 in which the decompression pin 191 is installed. As the decompression pin 191 is provided in the pin insertion part 172, the space where the oil flows can be reduced and the pressure of the oil can be lowered.

The pin insertion part 172 may be formed in the first end plate part 171 and extend in the radial direction. A communication hole 174 that guides the oil discharged from the rotational shaft 140 to the pin insertion part 172 is formed on the bottom surface of the first end plate part 171.

As described above, the inside of the casing 100 forms a high pressure, and the pressure of the oil supplied from the oil chamber 121 to the rotational shaft 140 also forms a high pressure. On the other hand, the refrigerant suctioned into the compression chamber through the suction part 112 can form a low pressure. Therefore, the oil can flow upward from the oil chamber 121 due to the pressure difference between the high pressure inside the casing 100 and the low pressure formed on a suction side of the compression chamber.

The pressure of the oil needs to be reduced so as to balance the pressure of the oil flowing into the compression chamber and the pressure on the suction side of the compression chamber. Specifically, the oil discharged from the rotational shaft 140 flows to the pin insertion part 172 through the communication hole 174. The pressure of the oil can be lowered while passing through the pin insertion part 172 which is narrowed by the decompression pin 191. The oil whose pressure is lowered can be supplied to the compression chamber to perform a lubricating operation.

The fixed scroll 160 is provided with a guide passage 164 that guides the flow of oil. The guide passage 164 can communicate with the pin insertion part 172 and can extend to the compression chamber. The oil that has passed through the pin insertion part 172 can be supplied to the compression chamber through the guide passage 164.

The flow of the oil discharged from the oil passage 140*a* will be briefly described hereinafter.

The oil stored in the oil chamber 121 rises along the oil passage 140*a* due to the pressure difference between the high pressure inside the casing 100 and the low pressure on the suction part 112 side. At least a part or portion of the oil discharged from the oil passage 140*a* flows through the space between the second bearing 185 and the inner circumferential surface portion 143*a*, and flows to the pin insertion part 172 side of the orbiting scroll 170 through the communication hole 174.

The remaining oil in the oil discharged from the oil passage 140*a* passes through the first supply passage 147*a* between the second bearing 185 and the first recess part 145*a* and flows into the guide holes 146*a* and 146*b*. The oil that has passed through the guide holes 146*a* and 146*b* can flow into the second supply passage 147*b* between the first bearing 181 and the second recess part 145*b*.

As a plurality of guide holes 146 can be spaced apart from each other in the vertical direction, the oil may flow into lower and upper portions of the second supply passage 147*b* through the plurality of guide holes 146. For example, the oil may flow into the lower portion of the second supply passage 147*b* through the first guide hole 146*a* and flow to the upper portion of the second supply passage 147*b* through the second guide hole 146*b*.

The oil in the second supply passage 147*b* may be restricted from flowing to the upper end of the outer circumferential surface portion 143*b* by the jaw 145*c*. Therefore, the oil flowing into the second supply passage 147*b* may flow again into the first supply passage 147*a* through the first guide hole 146*a* or the second guide hole 146*b*. The oil of the first supply passage 147*a* may flow upward into the first recess part 145*a* and may flow into the pin insertion part 172 through the communication hole 174.

Figure 7A:
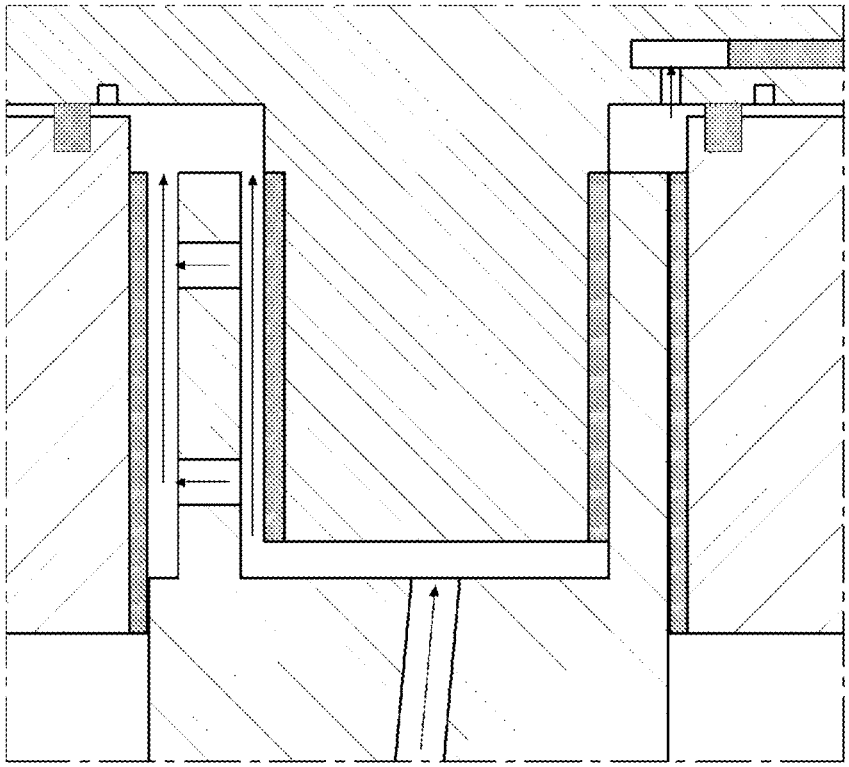
Fig. 7A RELATED ART
FIGS. 7A to 7D are views illustrating a comparison between an oil supply structure according to an embodiment and an oil supply structure according to a comparative example, showing that oil supply performance of the structure according to the embodiment is improved.
Figure 7B:
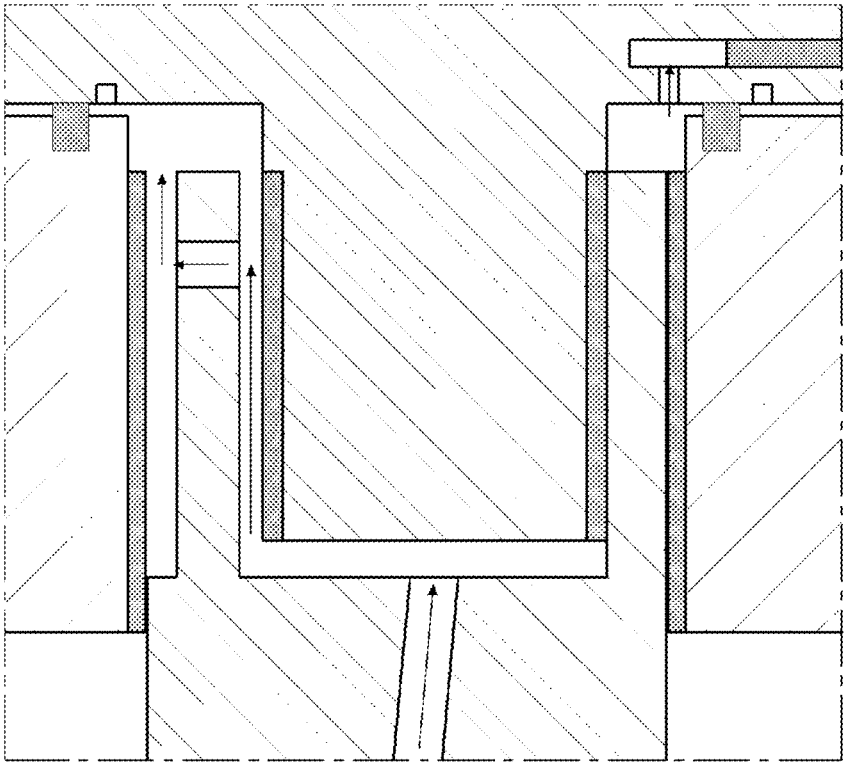
Fig. 7B RELATED ART
Figure 7C:
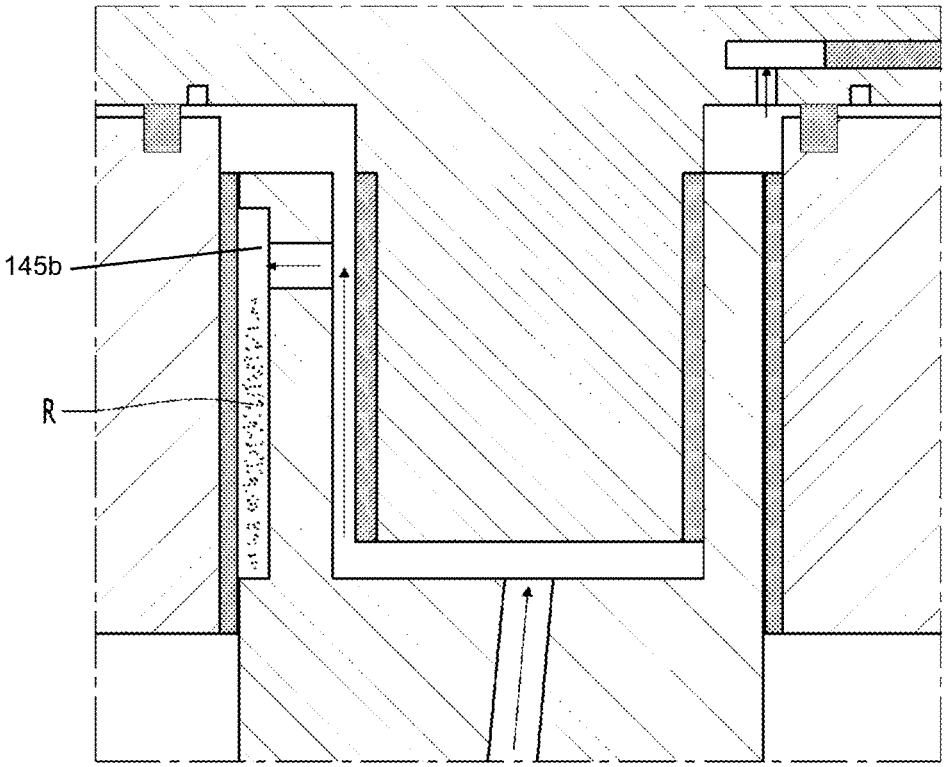
Fig. 7C RELATED ART
Figure 7D:
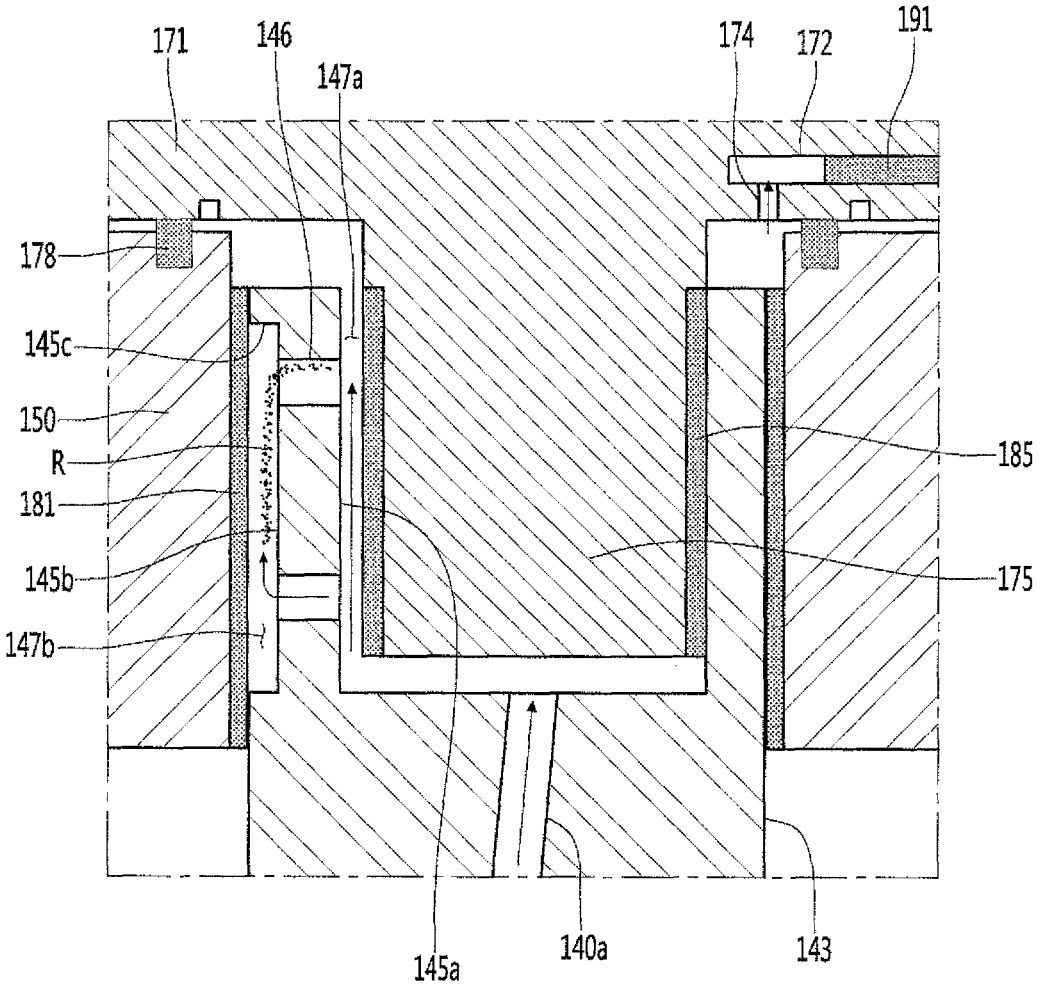

FIGS. 7A to 7D are views illustrating a comparison between an oil supply structure according to an embodiment and an oil supply structure according to a comparative example, showing that oil supply performance of the structure according to the embodiment is improved. FIGS. 7A to 7C illustrate views of structures of scroll compressors according to the related art (a control group), and FIG. 7D illustrates a structure of a scroll compressor according to an embodiment.

Specifically, FIG. 7A illustrates a structure in which the jaw 145*c* according to the embodiment is not provided. In this case, the oil flowing into the second supply passage between the first bearing and the second recess part can flow to the upper end of the outer circumferential surface portion. That is, the amount of oil supplied from the oil passage to the first supply passage is reduced, and most of the oil is discharged to the upper portion of the second supply passage through the second supply passage.

FIG. 7B illustrates a structure in which guide holes are provided in a single number as compared with FIG. 7A. In this case, the problem described with reference to FIG. 7A may appear.

FIG. 7C illustrates a structure in which a plurality of guide holes are not provided according to the embodiment, and only the upper portion of the second recess part 145*b* is formed. In this case, the oil may flow into the second supply passage through the guide hole, but due to the supply from the lower side of the second supply passage is restricted due to the gas refrigerant (R) remaining on the lower side of the second supply passage, in particular, the gas refrigerant existing at the initial start of the scroll compressor (vapor lock).

FIG. 7D illustrates the structure of the scroll compressor according to the embodiment. The oil may flow into the second supply passage 147*b* through the plurality of guide holes 146*a* and 146*b*, or may be discharged from the second supply passage 147*b*. The oil flowing into the lower portion of the second supply passage 147*b* through the first guide hole 146*a* can push up the gas refrigerant R remaining in the second supply passage 147*b*. Therefore, the gas refrigerant R can be discharged from the second supply passage 147*b*. Therefore, the oil can also be appropriately supplied to the lower portion of the second supply passage 146*b*.

As described above, as the first recess parts 145*a* and 145*b*, the guide holes 146*a* and 146*b* for connecting the first and second recess parts 145*a* and 145*b*, and the jaw 145*c* are provided in the first frame support part 143 of the rotational shaft 140, the oil can be appropriately supplied to the first and second bearings 181 and 185, and the gas refrigerant remaining in the second supply passage 147*b* can be discharged at the time of the initial start of the scroll compressor, thereby obtaining the effect of improving oil supply performance.

According to the embodiments, as the boss part of the orbiting scroll is configured to be inserted into the upper portion of the rotational shaft and the main frame is supported on the outer side of the rotational shaft, frictional loss of the bearing can be reduced by reducing the eccentric load acting on the rotational shaft, and thus, compression efficiency can be improved. Therefore, industrial applicability is remarkable.

The invention claimed is:

1. A scroll compressor, comprising:

a rotational shaft in which an oil passage is formed;

a main frame that supports an outer surface of the rotational shaft;

a first scroll supported by the main frame and performing an orbiting movement by rotation of the rotational shaft;

a first bearing provided between the main frame and the rotational shaft; and a second bearing provided between the first scroll and the rotational shaft, wherein the rotational shaft comprises:

a frame support having an inner circumferential surface into which a boss of the first scroll is inserted, and an outer circumferential surface forming the outer surface of the rotational shaft, wherein the frame support comprises a first recess formed in the inner circumferential surface of the frame support and a second recess formed in the outer circumferential surface of the frame support; and a plurality of guide holes that extends from the first recess to the second recess, the plurality of guide holes being configured to guide a flow of oil, wherein the plurality of guide holes comprises:

a first guide hole that communicates with a lower side of the second recess; and a second guide hole that communicates with an upper side of the second recess, and wherein the frame support further comprises a jaw that forms an upper end of the second recess and restricts the oil flowing through the second recess from flowing upward through an upper end of the frame support.

2. The scroll compressor according to claim 1, wherein the jaw comprises a step that extends from the upper end of the second recess in a radial direction and is connected to the outer circumferential surface of the frame support.

3. The scroll compressor according to claim 1, further comprising a first supply passage formed between the first recess and the second bearing, the first supply passage being configured to guide the flow of oil.

4. The scroll compressor according to claim 3, further comprising a second supply passage formed between the second recess and the first bearing, the second supply passage being configured to guide the flow of oil.

5. The scroll compressor according to claim 4, wherein the first supply passage and the second supply passage communicate with each other via the plurality of guide holes, and the first supply passage transfers oil discharged from the oil passage of the rotational shaft to the second supply passage.

6. The scroll compressor according to claim 1, wherein the first scroll comprises a first end plate and a first wrap that extends upward from the first end plate, and wherein the boss extends downward from the first end plate.

7. The scroll compressor according to claim 6, wherein the second bearing is provided on an outer circumferential surface of the boss.

8. The scroll compressor according to claim 6, wherein the first end plate of the first scroll comprises:

a pin insertion portion in which a decompression pin is installed; and a communication hole formed on a bottom surface of the first end plate, the communication hole being configured to guide oil to the pin insertion portion.

9. The scroll compressor according to claim 6, further comprising an oldham ring provided between the first end plate of the first scroll and an upper surface of the main frame.

10. The scroll compressor according to claim 1, wherein the first bearing is provided on the outer circumferential surface of the rotational shaft.

11. The scroll compressor according to claim 1, wherein a central portion of the frame support and a central portion of the boss of the first scroll are eccentric so that the first scroll performs the orbiting movement by rotation of the rotational shaft.

12. A scroll compressor, comprising:

a rotational shaft in which an oil passage is formed and having an outer circumferential surface and an inner circumferential surface;

a main frame that supports a frame support of the rotational shaft, wherein the frame support comprises a first recess formed in the inner circumferential surface of the rotational shaft and a second recess formed in the outer circumferential surface of the rotational shaft;

a first scroll supported by the main frame, performing an orbiting movement by rotation of the rotational shaft, and comprising a first end plate and a boss that extends downward from the first end plate;

a first bearing provided between the main frame and the outer circumferential surface of the rotational shaft;

a second bearing provided between the boss of the first scroll and the inner circumferential surface of the rotational shaft;

a first supply passage formed between the second bearing and the inner circumferential surface of the rotational shaft;

a second supply passage formed between the first bearing and the frame support; and a plurality of guide holes formed in the rotational shaft and connecting the first supply passage to the second supply passage, wherein the plurality of guide holes comprises:

a first guide hole that communicates with a lower side of the second recess; and a second guide hole that communicates with an upper side of the second recess, and wherein the frame support further comprises a jaw that forms an upper end of the second recess and restricts the oil flowing through the second supply passage from flowing upward through an upper end of the frame support.

13. The scroll compressor according to claim 12, wherein the main frame comprises:

a frame outer wall having an annular shape; and a frame inner wall disposed inside the frame outer wall and having a shaft insertion portion into which the rotational shaft is inserted, and wherein the first bearing is installed in the shaft insertion portion, and the frame support is connected to an inside of the first bearing.

14. The scroll compressor according to claim 13, wherein the frame support comprises a bearing insertion portion into which the boss and the second bearing are inserted, and the inner circumferential surface of the rotational shaft extends downward from the bearing insertion portion and forms an inner circumferential surface of the frame support.

15. The scroll compressor according to claim 12, wherein the plurality of guide holes extends from the first recess to the second recess.

16. The scroll compressor according to claim 15, wherein the jaw comprises a step that extends from the second recess in an outwardly radial direction and connected to the outer circumferential surface of the rotational shaft.

17. A scroll compressor, comprising:

a rotational shaft in which an oil passage is formed;

a main frame that supports an outer surface of the rotational shaft;

a first scroll supported by the main frame and performing an orbiting movement by rotation of the rotational shaft;

a first supply passage formed between the main frame and the rotational shaft; and a second supply passage formed between the first scroll and the rotational shaft, wherein the rotational shaft comprises:

a frame support having an inner circumferential surface into which a boss of the first scroll is inserted, and an outer circumferential surface forming the outer surface of the rotational shaft, wherein the frame support further comprises a first recess formed in the inner circumferential surface and a second recess formed in the outer circumferential surface; and a plurality of guide holes that extends from the first recess of the frame support to the second recess, the plurality of guide holes being configured to guide a flow of oil from the second supply passage to the first supply passage, wherein the plurality of guide holes comprises:

a first guide hole that communicates with a lower side of the second recess; and a second guide hole that communicates with an upper side of the second recess, and wherein the frame support further comprises a jaw that forms an upper end of the second recess and restricts the oil flowing through the second supply passage from flowing upward through an upper end of the frame support.

* * * * *